US010293389B2

(12) United States Patent
Sanders et al.

(10) Patent No.: US 10,293,389 B2
(45) Date of Patent: May 21, 2019

(54) METAL SHEET AND METHOD FOR ITS MANUFACTURE

(71) Applicant: GM GLOBAL TECHNOLOGY OPERATIONS LLC, Detroit, MI (US)

(72) Inventors: Ronald Sanders, Daxweiler (DE); Hartmut Baumgart, Bischofsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 547 days.

(21) Appl. No.: 14/963,410

(22) Filed: Dec. 9, 2015

(65) Prior Publication Data

US 2016/0167096 A1 Jun. 16, 2016

(30) Foreign Application Priority Data

Dec. 11, 2014 (DE) ..... 10 2014 018 409

(51) Int. Cl.

| | |
|---|---|
| ***B21B 3/00*** | (2006.01) |
| ***C22F 1/04*** | (2006.01) |
| ***C21D 9/48*** | (2006.01) |

(52) U.S. Cl.

CPC ..... *B21B 3/00* (2013.01); *C21D 9/48* (2013.01); *C22F 1/04* (2013.01); *B21B 2003/001* (2013.01)

(58) Field of Classification Search

None

See application file for complete search history.

(56) References Cited

U.S. PATENT DOCUMENTS

| | | | | |
|---|---|---|---|---|
| 4,828,932 | A * | 5/1989 | Morimoto | E04C 2/08 181/292 |
| 5,972,134 | A | 10/1999 | Buschsieweke et al. | |
| 9,718,145 | B2 | 8/2017 | Itoh et al. | |
| 2014/0345757 | A1 | 11/2014 | Hartmann et al. | |
| 2014/0356583 | A1* | 12/2014 | Sanders | B32B 15/04 428/172 |
| 2016/0288248 | A1* | 10/2016 | Itoh | C22C 21/00 |

FOREIGN PATENT DOCUMENTS

| | | | |
|---|---|---|---|
| DE | 102006034620 | A1 | 1/2008 |
| EP | 0633182 | A1 | 1/1995 |
| JP | S52134849 | A | 11/1977 |
| JP | 2013163214 | A | 8/2013 |
| WO | 2004087981 | A2 | 10/2004 |
| WO | WO2004087981 | * | 10/2004 |

OTHER PUBLICATIONS

Great Britain Patent Office, Great Britain Search Report for Great Britain Application No. GB1519897.1 dated Jun. 22, 2016.

* cited by examiner

*Primary Examiner* — Daniel J. Schleis

(74) *Attorney, Agent, or Firm* — Lorenz & Kopf, LLP

(57) ABSTRACT

A metal sheet that features a substructure of a first aluminum alloy and at least one reinforcement that is pressed into at least one surface of the substructure, wherein the reinforcement has in at least a direction extending parallel to the surface a large extent in relation to the thickness of the metal sheet and consists of a second aluminum alloy that is harder than the first aluminum alloy.

11 Claims, 2 Drawing Sheets

METAL SHEET AND METHOD FOR ITS MANUFACTURE

CROSS-REFERENCE TO RELATED APPLICATION

This application claims priority to German Patent Application No. 102014018409.9, filed Dec. 11, 2014, which is incorporated herein by reference in its entirety.

TECHNICAL FIELD

The present disclosure pertains to a metal sheet featuring a substructure of light metal and at least one reinforcement that is pressed into at least one surface of the substructure.

BACKGROUND

Methods for treating metal sheets in order to produce sheet metal parts with locally modified properties, particularly greater strengths, are generally known.

Sheet metal parts with locally greater strengths can be produced by increasing the material thickness. DE 10 2006 034 620 A1 describes a method for manufacturing sheet metal parts, in which a reinforcement is applied onto an area of a substructure by means of laser welding. Since no pressure can be exerted upon the welding point during the laser welding operation, the quality of the weld significantly depends on how soft the reinforcement becomes under the influence of the laser beam and how intimately it thereby adapts to the substructure. The quality of the laser beam therefore significantly influences the welding results. The different mechanical properties in the reinforced and in the unreinforced areas of the metal sheets lead to high tensions when the welding seams and the adjacent heat-affected zone are subjected to loads. This may cause the metal sheet to tear open in or adjacent to the welded joint.

After the reinforcement has been welded on, the overall thickness of the metal sheet is greater in the area of the reinforcement than in the unreinforced area. This conventional metal sheet is not suitable for applications, in which a uniform thickness is required over the entire metal sheet. It is particularly unsuitable for deep-drawing because the abrupt differences in thickness in the metal sheet can only be insufficiently considered in the deep-drawing tool.

DE 6 940 1390 T2 discloses an aluminum sheet, on which a perforated sheet or a grating of steel is fastened by means of cold forming in order to create a structural component, the mechanical strength of which is greater than that of just the aluminum sheet.

The intimate connection between steel and aluminum in this conventional structural component significantly complicates recycling. The structural component has a strong tendency to contact corrosion and therefore requires, in contrast to the original aluminum sheet, effective corrosion protection on its surface. However, if a paint layer is conventionally applied onto the structural component as corrosion protection, the different coefficients of thermal expansion of aluminum and steel promote the separation of this corrosion protection layer precisely at the boundaries between the materials.

Another problem in the further processing of this known structural component can be seen in that connecting techniques suitable for aluminum are frequently incompatible with a steel surface and vice versa; in particular, different operating parameters are required for welding aluminum than for welding steel. If another component should be welded onto the structural component, it therefore must be known beforehand whether it should be welded to a steel surface or an aluminum surface, wherein welding seams extending over both types of surfaces cannot be produced. Repair work is particularly difficult under this conditions.

SUMMARY

It is an objective of the invention to disclose a locally reinforced metal sheet, in which these disadvantages are eliminated.

According to an embodiment of the invention, this objective is attained with a metal sheet featuring a substructure of a first aluminum alloy and at least one reinforcement of a second aluminum alloy that is pressed into at least one surface of the substructure, wherein the reinforcement has in at least a direction extending parallel to the surface a large extent in relation to the thickness of the metal sheet and consists of a second aluminum alloy that is harder than the first aluminum alloy.

The reinforcement can come in intimate contact with the substructure over a majority of its surface by pressing the reinforcement into the surface of the metal sheet such that tensions between the reinforcement and the substructure are distributed over a large surface. This particularly simplifies the subsequent forming of the metal sheet, during which such tensions occur. Subsequent forming of the metal sheet, particularly by means of deep-drawing, is also simplified due to the fact that the thickness of the metal sheet in the reinforced area only slightly exceeds the thickness in the unreinforced area.

The reinforcement may be formed, in particular, by a wire, a strip, a netting or a grating. The netting or the grating may consist of intersecting wires or strips or be formed by a rib mesh. The load characteristics can be purposefully adjusted with the width and the density of the linear reinforcements and the geometric parameters of the netting-like or grating-like reinforcements.

The wires or strips of a grating may feature engaging recesses at their intersecting points. These recesses may be formed by rolling the intersecting wires or strips on top of one another, wherein the wires or strips thereby may, in particular, already be connected into a grating before being pressed into the substructure, e.g. by means of cold-welding.

The reinforcement may be pressed into the substructure so deep that it is also positively held therein. This can be achieved, in particular, by rolling in the reinforcement.

The reinforcement may be hardenable or already hardened by means of a heat treatment of the metal sheet. Prior to the hardening operation, the metal sheet can be formed in a state of low strength in order to produce finished parts with the desired shape thereof, wherein the desired increase in strength of these finished parts is subsequently achieved by means of the heat treatment.

The substructure may have a greater strength in an area situated adjacent to the pressed-in reinforcement than in an area situated distant from the reinforcement due to strain-hardening. This effect contributes to the strength of the metal sheet, in particular, if no heat treatment is carried out after the deformation caused by pressing in the reinforcement.

The first aluminum alloy preferably belongs to the alloy group 1xxx whereas the second aluminum alloy belongs to the alloy group 5xxx, 6xxx or 7xxx.

The reinforcement may be covered with a coating and thereby protected against corrosion. The coating should also extend to areas of the substructure that are situated directly adjacent to the reinforcement; the simplest solution with respect to the manufacturing technology consists of completely covering the substructure and the reinforcement with the coating.

The coating may be a foil consisting of the same material as the substructure. This is particularly advantageous with respect to sound corrosion properties.

A paint layer may also be considered as coating. Since the two aluminum alloys only differ slightly with respect to their coefficients of thermal expansion, such a paint layer only has a low tendency to suffer damages during temperature fluctuations. This is the reason why the paint layer may be realized, in particular, in the form of a stove-enameled coating.

It is another objective of the invention to disclose a method for manufacturing a locally reinforced metal sheet.

According to an embodiment of the invention, this objective is attained with a method for manufacturing a metal sheet by placing a reinforcement of a second aluminum alloy onto a substructure of a first aluminum alloy, wherein the second aluminum alloys harder than the first aluminum alloy, and subsequently rolling the reinforcement into the substructure.

In this way, the thickness of the metal sheet in a reinforced area may only exceed the thickness of the unreinforced area minimally or not at all. The more intensive the cold-welding of the reinforcement and the substructure is carried out while the reinforcement is rolled in, the more substantial the metal sheet can subsequently be deformed without thereby causing a separation of the reinforcement and the substructure. A positive fit between reinforcement and substructure material produced by rolling in the reinforcement also contributes to preventing such a separation.

If the metal sheet obtained by rolling in the reinforcement is sufficiently plane, it can be further processed by means of deep-drawing, wherein the deformation by means of deep-drawing may also concern the reinforcement itself.

A deformation of the metal sheet, which also concerns the rolled-in reinforcement, may cause additional strain-hardening of the reinforcement, namely regardless of whether it is carried out by means of deep-drawing or a different method. This strain-hardening contributes to the strength of a workpiece produced of the metal sheet, in particular, if the deformation takes place at room temperature and no heat treatment is subsequently carried out.

Furthermore, hardening of the reinforcement may be obtained by a heat treatment of the metal sheet, which may be carried out during or after the forming operation. This hardening contributes to the strength of the metal sheet, in particular, if the reinforcement is formed by an alloy that was subjected to precipitation hardening.

Additionally, corrosion resistance may be obtained by applying a coating at least onto the reinforcement, which may be carried out after rolling in the reinforcement. It is advantageous if the step of applying the coating is the step that immediately follows the step of rolling in the reinforcement. If the coating consists of a foil, an intimate connection between foil and metal sheet can be produced by rolling on the foil.

The process of rolling in the reinforcement and/or, if applicable, rolling on the foil may take place under an inert gas atmosphere or reducing atmosphere. The fewer interfering oxide layers on the surfaces to be connected, the more intensive the cold-welding of the reinforcement, the substructure and, if applicable, the foil is carried out while the reinforcement is rolled in. This is the reason why it may be sensible to carry out a pickling step for removing an oxide layer as preparation for the rolling-in operation.

The coating may also be a paint layer. Since the coefficients of thermal expansion of the aluminum alloys only differ slightly, such a paint layer also is only subjected to low tensile stresses during temperature fluctuations; a durable paint layer can be produced, in particular, at a temperature that is higher than the subsequent service temperature of a component produced of the metal sheet by means of stove-enameling.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
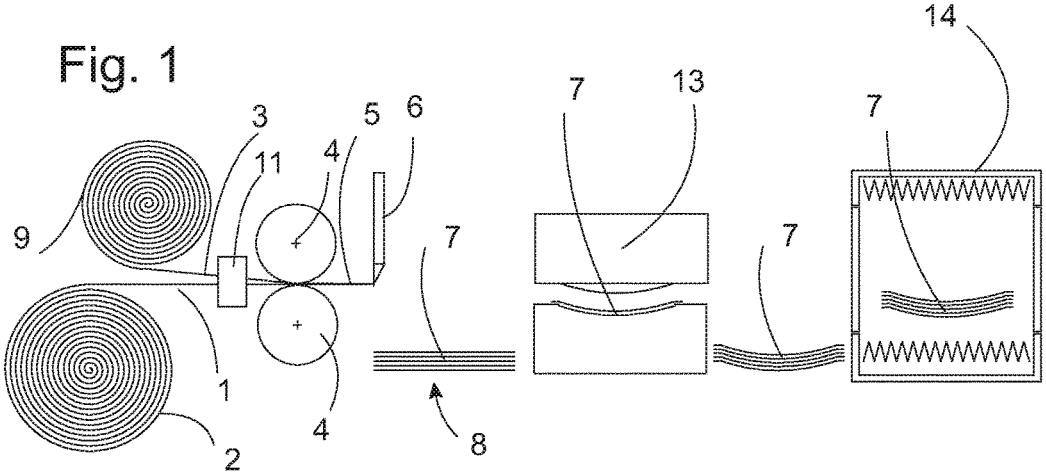
FIG. 1 shows the schematic sequence of a method according to a first embodiment of the invention.

FIG. 1 schematically shows different stages of an inventive method for manufacturing metal sheets. In a first stage illustrated in the left portion of FIG. 1, a substructure 1 consisting of a low-alloy aluminum sheet, preferably of an alloy of the alloy group 1xxx, is unwound from a coil 2.

A reinforcement 3 in the form of a wire is unwound from a spool 9. The reinforcement 3 may also be formed by several wires that are unwound from adjacently arranged spools 9.

In this case, the reinforcement 3 consists of an aluminum alloy that can be aged artificially, preferably an alloy of the alloy group 6xxx. In its initial state on the spool 9, the reinforcement 3 has a greater strength than the substructure material 1. The difference in strength should amount to at least 200 MPa.

The substructure 1 and the reinforcement 3 are conveyed through a pickling bath 11. The pickling bath may contain NaOH or $HNO_3$. The pickling in the pickling bath 11 removes oxides that cover the surfaces of the substructure 1 and the reinforcement 3.

Subsequently, the substructure 1 and the reinforcement 3 are jointly conveyed between two rollers 4. During this operation, the reinforcement 3 is pressed into the surface of the substructure 1. Cold-welding of the reinforcement 3 and the substructure 1 takes place during this rolling-in operation. The fewer interfering oxide layers on the surfaces of the reinforcement 3 and the substructure 1, the more intensive the cold-welding is carried out. In order to prevent the regeneration of oxide layers after pickling has been carried out, the rolling-in operation may take place under an inert gas atmosphere or reducing atmosphere.

Figure 2:
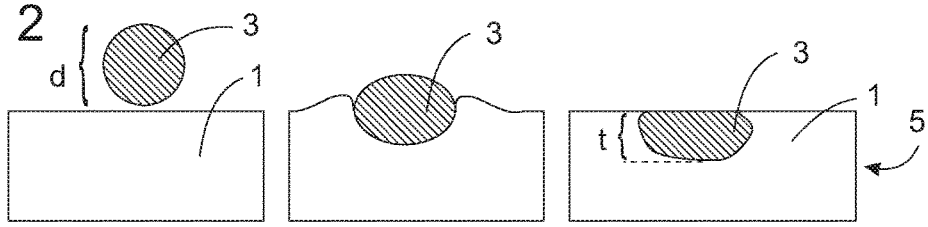
FIG. 2 shows different stages of the rolling-in operation.

The gap between the rollers 4 is adjusted in such a way that a metal sheet 5, in which the surface of the reinforcement 3 and the surface of the substructure 1 are flush with one another, is obtained after the pass through the pair of rollers 4. FIG. 2 shows different stages of the process of rolling in a wire-shaped reinforcement 3. The reinforcement 3 and the substructure 1 are illustrated in the form of a cross section prior to the rolling-in operation on the left side in FIG. 2. The central portion of FIG. 2 shows the partially rolled-in reinforcement 3. The displaced material of the substructure 1 is pressed upward like a bead adjacent to the reinforcement 3. The right portion of FIG. 2 shows the metal sheet 5 at the end of the rolling operation. The reinforcement 3 and the surface of the substructure 1 are flush with one another. The displaced material of the substructure 1 partially extends over the reinforcement 3 such that a positive fit is produced.

The reinforcement 3 has to have a greater strength than the substructure 1 in order to achieve a penetration depth t of the reinforcement 3 that amounts to at least half the thickness d of the reinforcement prior to the rolling-in operation.

The rolling-in operation may take place during the last pass of the hot-rolling operation of the substructure 1. In this case, the substructure 1 including reinforcement 3 is rolled to the desired sheet thickness of the metal sheet 5.

Figure 3:
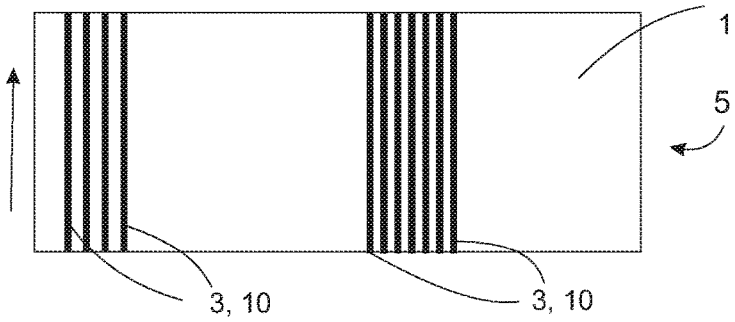
FIG. 3 shows a top view of a metal sheet.

FIG. 3 shows a top view of an example of the reinforcement 3 in the metal sheet 5. In this case, the reinforcement 3 consists of several wires 10 that extend in a straight line and parallel to one another in the rolling direction symbolized by an arrow. A reinforcement in the form of curved wires can be realized if the spools 9, from which the wires 10 are unwound, are moved transverse to the rolling direction during the rolling-in operation or the wires 10 are guided through eyelets that can be moved relative to the rolling direction before they enter the gap between the rollers 4.

After the rolling operation, the sheet metal strip 5 is divided into sheet metal blanks 7 by means of a cutting device 6. The sheet metal blanks 7 are deposited on a stack 8 if the sheet metal strip 5 has to be transported to a different location for further processing after its manufacture.

Otherwise, the sheet metal blanks 7 can be directly placed into a forming tool 13 after the cutting operation. In FIG. 1, a sheet metal blank 7 placed into the forming tool 13 for deep-drawing is illustrated on the right side adjacent to the stack 8. The more intensive the cold-welding between the substructure 1 and the reinforcement 3 and the more pronounced the positive fit between reinforcement 3 and the substructure 1, the more substantial the metal sheet 5 can be deformed without thereby separating the reinforcement 3 and the substructure 1.

The formed sheet metal blanks 7 are subjected to a heat treatment in a furnace 14 that is illustrated on the right side in FIG. 1. During this heat treatment, precipitation hardening takes place in the reinforcement 3, which consists of an alloy that can be aged artificially, such that the strength of the reinforcement 3 is increased. In this way, sheet metal parts can be locally reinforced while areas situated distant from the reinforcement 3 have a lower strength, but generally a greater ductility and/or superior weldability.

According to FIG. 1, several of the formed sheet metal blanks 7 can be simultaneously heat-treated in the furnace 14 during the heat treatment. However, it is also possible to individually heat-treat the sheet metal blanks 7 successively in a continuous furnace. In sheet metal blanks 7 to be painted, precipitation hardening may take place during the stove-enameling heat treatment.

Figure 4:
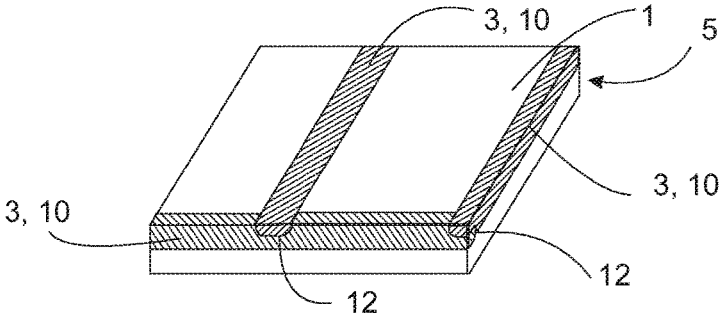
FIG. 4 shows a section of the metal sheet for a first variation.

According to a first variation, the wires 10 of the reinforcement 3 may extend in the metal sheet 5 in such away that they intersect one another and form a grating. In this case, the wires 10 feature deformations produced by the rolling-in operation at the intersecting points, wherein these deformations are illustrated in FIG. 4 in the form of engaging recesses 12 in the wires 10. Due to the rolling-in operation, the wires 10 are cold-welded at the intersecting points.

The reinforcement 3 may also consist of a prefabricated grating of intersecting wires 10 that are rolled on top of one another, wherein this prefabricated grating is unwound from the spool 9 in order to be processed. The wires 10 are rolled on top of one another in an intersecting fashion such that they are cold-welded at the intersecting points. It is preferred that the thickness of the reinforcement grating 3 at the intersecting points only exceeds the thickness of the wires 10 between the intersecting points slightly or not at all.

Figure 5:
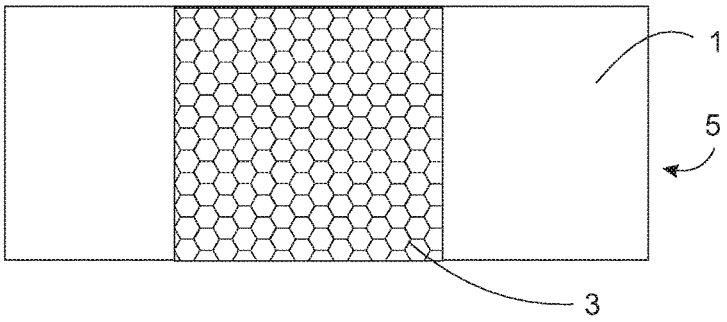
FIG. 5 shows a top view of the metal sheet for a second variation.
Figure 6:
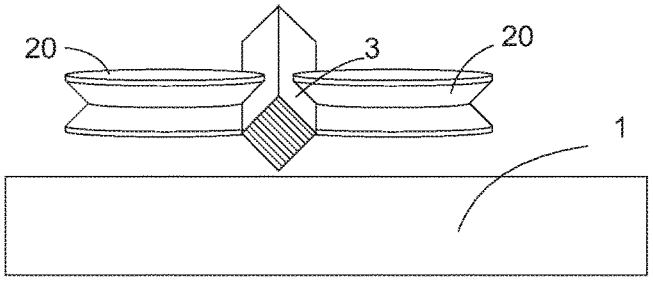
FIG. 6 shows a section through the substructure and the reinforcement for a third variation.

According to a second variation, the reinforcement 3 may also have a netting-like structure as illustrated in FIG. 5. The netting-like structure may consist, for example, of a rib mesh.

According to a third variation, the reinforcement 3 may consist of a narrow strip or wire with a sharp-edged cross section such as, e.g., a rectangular cross section. In order to ensure that the strip reliably cuts into the surface of the substructure 1 during the rolling-in operation, the strip is held above the surface of the substructure 1 in such a way that one of the sharp edges faces the surface. This can be achieved, e.g., by guiding the strip through an eyelet or between two rolls, which respectively defines or define a passage complementary to the cross section of the strip, shortly before the strip enters the gap between the rollers 4. Reinforcing elements with rectangular cross section and limited length can be produced of an alloy that is unsuitable for drawing wires, e.g., by cutting strips off a metal sheet. In order to ensure that such elements lie on the substructure such that one of their sharp edges faces the substructure, they can be bent before being placed thereon.

In a second exemplary embodiment, the reinforcement 3 consists of an aluminum alloy of the alloy group 5xxx that was subjected to significant strain-hardening. In this case, the reinforcement 3 also should have a strength that is at least 200 MPa greater than that of the substructure 1 in its initial state on the spool 9.

The deep-drawing operation in the forming tool 13 is carried out in the form of a cold-forming operation. The substructure 1 and the reinforcement 3 are thereby deformed and strain-hardening occurs, particularly in the reinforcement 3. The desired strength of the sheet metal sections 5 is already achieved due to the deep-drawing operation. A subsequent heat treatment would diminish the increase in strength, which is the reason why no heat treatment in the furnace 14 according to FIG. 1 is carried out in the second exemplary embodiment.

Due to the process of rolling in the reinforcement 3, an area of the substructure 1 situated adjacent to the rolled-in reinforcement 3 has a greater strength than a region situated distant from the reinforcement 3 because strain-hardening occurs. However, the magnitude of this effect depends on the heat input during and after the rolling operation and only contributes to the increase in strength of the substructure 1 if no heat treatment is carried out after the forming operation.

In a third exemplary embodiment, the reinforcement 3 consists of an aluminum alloy of the alloy group 7xxx. In this case, the reinforcement 3 also should have a strength that is at least 200 MPa greater than that of the substructure 1 in its initial state on the spool 9. Aluminum alloys of the alloy group 7xxx can be aged artificially. The aging time and aging temperature can be chosen in such a way that aging is achieved during a hot-forming operation.

The forming operation in the forming tool 13 according to FIG. 1 therefore is carried out in the form of a hot-forming operation. It may be realized, in particular, in the form of a deep-drawing operation. The sheet metal blank 7 is heated and deformed in the forming tool 13 and subsequently cooled in contact with the tool 13. The reinforcement 3 is aged artificially due to the temperature influence such that the desired increase in strength is achieved. In this case, no heat treatment in the furnace 14 according to FIG. 1 is carried out after the forming operation.

Figure 7:
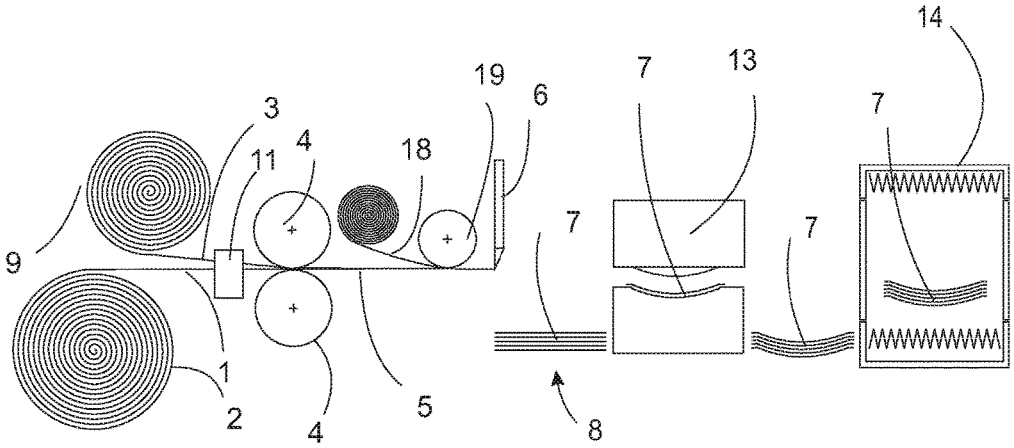
FIG. 7 shows the schematic sequence of a method for a fourth exemplary embodiment.

FIG. 7 schematically shows different stages of a fourth exemplary embodiment for manufacturing metal sheets. As in the first exemplary embodiment, the substructure 1 being unwound from a coil 2 and the reinforcement 3 being unwound from a spool 9 are rolled together into a sheet metal strip 5. A foil 18, which is unwound from a second coil, is subsequently supplied from above and transported underneath a pressing roller 19 together with the sheet metal strip 5. During this process, the foil 18 is pressed onto the surface of the sheet metal strip 5 by the roller 19. The foil 18 is rolled on under high pressure such that cold-welding with the sheet metal surface takes place. In order to achieve intensive cold-welding, the foil 18 may be pickled analogous to the substructure 1 prior to being pressed thereon. In order to prevent the formation of an oxide layer and to promote cold-welding, the substructure 1, the reinforcement 3 and the foil 18 may be exposed to an inert gas atmosphere or reducing atmosphere between the stage of rolling in the reinforcement 3 and the stage of rolling on the foil 18.

The foil 18 consists of low-alloy aluminum, preferably of the alloy group 1xxx. The foil 18 is positioned in such a way that it covers at least the reinforcement 3. However, the foil 18 preferably covers the entire surface of the metal sheet.

Negative effects of environmental influences can be prevented by covering the reinforcement 3 with the foil 18. In addition, corrosion-sensitive reinforcements 3 can be protected by being covered with foil. In this way, damages due to stress corrosion cracking of the reinforcement 3 and due to contact corrosion between the reinforcement 3 and the substructure 1 can be prevented. This is particularly advantageous in instances, in which a reinforcement 3 of the corrosion-sensitive alloy group 7xxx is used.

As in the first exemplary embodiment, the forming operation in the forming tool 13 and the heat treatment in the furnace 14, during which precipitation hardening takes place, are carried out after the sheet metal strip 5 has been cut into sections. A heat treatment in the furnace 14 can be eliminated if the reinforcement 3 consists of an alloy that was subjected to significant strain-hardening as in the second exemplary embodiment. The heat treatment in the furnace 14 is likewise eliminated if the reinforcement 3 consists of an alloy, in which precipitation hardening can be achieved during a hot-forming operation in the forming tool 13 as in the third exemplary embodiment.

The exemplary embodiments are not restricted to the cited materials and material combinations.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A metal sheet comprising a substructure of a first aluminum alloy and at least one reinforcement that is pressed into at least one surface of the substructure, wherein the reinforcement has a length in at least a direction extending parallel to the at least one surface greater than a thickness of the metal sheet and consists of a second aluminum alloy that is harder than the first aluminum alloy, wherein the reinforcement is covered with a coating and the coating comprises an aluminum alloy foil.

2. The metal sheet according to claim 1, wherein the reinforcement is selected from the group consisting of a wire, a strip, a netting or a grating.

3. The metal sheet according to claim 2, wherein the reinforcement comprises a grating having recesses at intersecting points.

4. The metal sheet according to claim 1, wherein the reinforcement is positively pressed into the substructure.

5. The metal sheet according to claim 1, wherein the reinforcement comprises a hardened reinforcement affected by a heat treatment.

6. The metal sheet according to claim 1, wherein the substructure comprises a first area situated adjacent to the pressed-in reinforcement having a first strength and a second area having a second strength, wherein the first strength is greater than the second strength due to strain-hardening of the first area.

7. A metal sheet comprising a substructure of a first aluminum alloy and at least one reinforcement that is pressed into at least one surface of the substructure, wherein the reinforcement has a length in at least a direction extending parallel to the at least one surface greater than a thickness of the metal sheet and consists of a second aluminum alloy that is harder than the first aluminum alloy, wherein the reinforcement is covered with a coating and the coating comprises a stove-enameled paint.

8. A method for manufacturing a metal sheet, comprising:

placing a reinforcement of a second aluminum alloy onto a substructure of a first aluminum alloy, wherein the second aluminum alloy is harder than the first aluminum alloy and the reinforcement has a length in at least a direction extending parallel to a surface of the substructure of the first aluminum alloy greater than a thickness of the metal sheet, subsequently rolling the reinforcement into the substructure; and applying a coating at least onto the reinforcement after rolling the reinforcement into the substructure, wherein the coating comprises one of an aluminum alloy foil and a stove-enameled paint.

9. The method for manufacturing a metal sheet according to claim 8, further comprising:

forming the reinforcement by deep-drawing the metal sheet carried out after the rolling the reinforcement into the substructure.

10. The method for manufacturing a metal sheet according to claim 8, further comprising:

hardening the reinforcement by forming the metal sheet after rolling the reinforcement into the substructure.

11. The method for manufacturing a metal sheet according to claim 8, further comprising:

hardening the reinforcement by means heat treating the metal sheet after rolling the reinforcement into the substructure.

* * * * *